US010876328B2

(12) United States Patent
Beck et al.

(10) Patent No.: US 10,876,328 B2
(45) Date of Patent: Dec. 29, 2020

(54) DOOR HANDLE ASSEMBLY FOR A MOTOR VEHICLE

(71) Applicant: Huf Huelsbeck & Fuerst GmbH & Co. KG, Velbert (DE)

(72) Inventors: Andreas Beck, Bochum (DE); Dirk Mueller, Essen (DE); Raimund Huebner, Wuppertal (DE); Matthias Loew, Ratingen (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 349 days.

(21) Appl. No.: 15/557,662

(22) PCT Filed: Feb. 15, 2016

(86) PCT No.: PCT/EP2016/053106
§ 371 (c)(1),
(2) Date: Sep. 12, 2017

(87) PCT Pub. No.: WO2016/155934
PCT Pub. Date: Oct. 6, 2016

(65) Prior Publication Data

US 2018/0066459 A1 Mar. 8, 2018

(30) Foreign Application Priority Data

Mar. 30, 2015 (DE) ..... 10 2015 104 870

(51) Int. Cl.
*E05B 79/06* (2014.01)
*E05B 79/10* (2014.01)
(Continued)

(52) U.S. Cl.
CPC ..... *E05B 79/06* (2013.01); *E05B 79/10* (2013.01); *E05B 83/36* (2013.01); *E05B 85/16* (2013.01)

(58) Field of Classification Search
CPC ..... E05B 79/06; E05B 83/36; E05B 79/10; E05B 85/16
See application file for complete search history.

(56) References Cited

U.S. PATENT DOCUMENTS 4,125,008 A * 11/1978 Genest ..... E05B 47/0002 292/280
5,975,597 A 11/1999 Makiuchi et al.
(Continued)

FOREIGN PATENT DOCUMENTS

DE 10 2005 049 027 A1 4/2007
DE 10 2007 027 847 A1 12/2008
(Continued)

OTHER PUBLICATIONS

International Search Report of International Application No. PCT/EP2016/053106 dated May 20, 2016, 6 pages.
(Continued)

*Primary Examiner* — Kristina R Fulton
*Assistant Examiner* — Thomas L Neubauer
(74) *Attorney, Agent, or Firm* — Fay Sharpe LLP

(57) ABSTRACT

A door handle assembly for a motor vehicle includes a handle carrier mounted on the vehicle and a grip part rotatably mounted on the handle carrier. The grip part opens a door or flap of the motor vehicle. A coupling device is rotatably mounted on the handle carrier for transmitting an actuation of the grip part to a locking arrangement on the vehicle. A joint element pivotably interconnects the coupling device and the grip part. The joint element movably supports an actuating member which is moved by rotation translationally between mounting and operating positions. In the operating position, the actuating member is pivotably mounted on the coupling device and is in engagement with the grip part. In the mounting position, the actuating member bears against a blocking surface of the coupling device that
(Continued)

blocks rotation of the actuating member and is out of engagement with the grip part.

8 Claims, 5 Drawing Sheets

(51) Int. Cl.
*E05B 83/36* (2014.01)
*E05B 85/16* (2014.01)

(56) References Cited

U.S. PATENT DOCUMENTS

| | | | | |
|---|---|---|---|---|
| 9,650,806 | B2 * | 5/2017 | Beck | E05B 3/04 |
| 2018/0187458 | A1 * | 7/2018 | Beck | E05B 85/06 |

FOREIGN PATENT DOCUMENTS

| | | | | |
|---|---|---|---|---|
| DE | 10 2013 215 775 | A1 | 2/2015 | |
| DE | 102014102682.9 | * | 1/2017 | E05B 85/06 |
| EP | 2 949 842 | A1 | 12/2015 | |

OTHER PUBLICATIONS

International Preliminary Report on Patentability and Written Opinion of International Application No. PCT/EP2016/053106 dated Oct. 3, 2017 and English Translation, 20 pages.

* cited by examiner

DOOR HANDLE ASSEMBLY FOR A MOTOR VEHICLE

BACKGROUND

The invention relates to a door handle assembly for a motor vehicle, which has a handle mount that can be installed on the vehicle, a handle that is rotatably supported on the handle mount for opening a door or hatch of the motor vehicle, and a coupling device rotatably supported on the handle mount, through which an actuation of the handle can be transferred to a locking assembly on the vehicle.

Such door handle assemblies for a motor vehicle can be configured as inner or outer handles, wherein the present invention relates primarily to a door handle assembly for an outer handle. There are numerous different constructions and embodiments for such door handle assemblies. The configuration of a door handle according to the invention relates to such configurations in which the handle mount, and the handle are attached to one another from opposite sides of the door of the motor vehicle. The handle mount is attached to the back surface of the door, i.e. on the inside of the motor vehicle, while the handle is installed on outside of the door. After installation, the two ends of the handle pass through respective holes in the door or in the door panel of the motor vehicle.

A door handle assembly of the type specified above is known, for example, from DE 10 2005 049 027 A1. This known door handle assembly has a handle mount attached to the door or the door panel on the inside, a handle and a coupling device. The handle is attached to the outside of the door in that the two ends of the handle are inserted through respective openings in the door and attached to the handle mount. The first end of the handle is rotatably supported on the handle mount in a floating manner. The play in the longitudinal direction of the handle mount associated with this type of support is necessary because the second end of the handle is non-rotatably connected to the coupling device. Consequently, due to the floating support of the first end and the fixed tightening of the second end, correspondingly large gaps must be taken into account, having a negative effect on the sealing of the overall door handle assembly. Furthermore, because of the floating bearing of the first end, the handle may wobble or slightly, or even noticeably, or snap abruptly into place, when it is actuated in order to open a door or hatch of the motor vehicle, which could give the user the impression that the handle is not functioning properly.

The invention addresses the object of creating a solution, which provides a door handle assembly with a simple construction, which can be produced cost-effectively, and with which the handle can be easily, quickly and comfortably installed on the handle mount.

BRIEF SUMMARY

With a door handle assembly of the type specified in the introduction, the object is achieved according to the invention in that a hinged element connects the coupling device and the handle to one another in a pivotal manner, wherein the hinged element moveably supports an actuating means that can be moved in a translatory manner between an installation position and an operating position through rotation thereof, which is supported in the operating position such that it can rotate toward the coupling device and is engaged with the handle, and which abuts a blocking surface of the coupling device that blocks a rotation of the actuating means when it is in the installation position, and is not engaged with the handle.

Advantageous and useful designs and developments of the invention can be derived from the dependent Claims.

The invention makes a door handle assembly for a motor vehicle available, which is distinguished by a functional construction and a simple and cost-effective design. With the door handle assembly according to the invention, the pivotal connection of the coupling device and the handle ensures that the handle can be pivoted in relation to the coupling device. As a result of this degree of freedom, it is possible to tighten the handle securely to the handle mount, such that the play of the handle in the axial direction, or in the longitudinal direction of the handle mount, known from the prior art, and consequently the gap, can be reduced to a minimum, making it possible to use simple and inexpensive sealing measures for the door handle assembly, resulting in a reduction in the production costs for the overall door handle assembly. Furthermore, the bearing and movement guidance of the handle in the door handle assembly according to the invention no longer needs to take place at the end of the handle pivotally supported on the handle mount. Instead, with the door handle assembly according to the invention, the coupling device guides the movement of the handle when it is actuated, such that the supporting of the end of the handle supported on the handle mount can take place with structurally simple means and cost-effectively. The hinged element assumes the advantageous function described above during operation of the handle, of connecting the handle and the coupling device to one another such that both can pivot in relation to one another, and are nevertheless moveably coupled to one another. The actuating means is provided for this purpose, which is supported on the hinged element such that it can move between an operating position and an installation position. In the operating position, the actuating means ensures that the hinged element is non-rotatably connected to the handle, and rotatably connected to the coupling device, while in the installation position, the function of the actuating means is to dispose the hinged element in relation to the coupling device such that it cannot rotate, in order to be able to install or remove the handle on the hinged element without the hinged element rotating thereby, making it more difficult to install or remove. The attachment of the hinged element to the coupling device takes place in that the actuating means is moved against a blocking surface. There is, however, the danger that during the installation or removal of the handle, the hinged element can become mechanically damaged, because the actuating means is subjected to excessive forces when moved against the blocking surface, and can become deformed such that the functioning of the door handle assembly can ultimately be compromised. On the other hand, there is also the danger that when an excessive force is applied in order to move the actuating element into the installation position, the hinged element is pushed out of position, which can also result in damage thereto. In order to avoid these risks, it is provided with the door handle assembly according to the invention that the actuating element bears on the blocking surface of the coupling device such that a rotation of the actuating means is blocked when it is in the installation position, thus preventing any further translatory movement of the actuating means beyond the installation position. In this manner, excessive forces to the actuating element pushing the hinged element out of position are effectively prevented.

A particularly simple possibility for effectively blocking the rotation of the actuating means is obtained with the design of the invention in that a longitudinal end of the actuating means is formed as a bearing surface that interacts with the blocking surface when in the installation position, and the blocking surface is provided with a rough surface. The roughness of the surface of the blocking surface creates friction, which acts against a rotation of the actuating means, and blocks the rotation thereof. The blocking effect is thus achieved by means of a frictional connection between the actuating means and the blocking surface.

As an alternative or additional possibility for blocking the rotation of the actuating means, the invention provides that the actuating means is designed as a screw, which has teeth on the top surface of its head, which interact with the blocking surface in the installation position. Accordingly, the teeth of the actuating means engage in the surface of the blocking surface, wherein the roughness, which provides a friction acting against the rotation of the actuating means, can increase the blocking effect, but need not do so. In this configuration, the blocking effect is obtained on the basis of a form fit.

In order to absorb a torque of the actuating means, in a further design the invention provides that the blocking surface is formed with at least one stop surface, against which a tooth of the teeth of the actuating means bears when in the installation position, blocking a rotation of the actuating means. In this manner, an axial force between the actuating means and the hinged element, which would otherwise push the hinged element out of position, never even arises.

A particularly simple possibility for implementing a hinge-like connection between the handle and the coupling device exists in the design of the invention in that a first end of the handle is rotatably supported on the handle mount, and a second end of the handle and the coupling device are moveably coupled to one another by means of a pivotal and hinge-like articulated connection formed such that when the handle is actuated, the second end of the handle pivots in relation to the coupling device. This possible design uses a minimum of components, because a bolt or screw connection, which rotatably connects the coupling device to the second end of the handle via the hinged element, is sufficient for obtaining the pivotal joint or hinge.

As an alternative to the design of the articulated joint as a pivotal joint or hinge, the invention provides that the articulated joint comprises the hinged element, which is non-rotatably connected to a hook formed on the second end of the handle via a form-fitting connection when the actuating means is in the operating position, and which is rotatably connected to the coupling device via an articulated connection. Thus, an intermediate component in the form of the hinged element is provided between the hook and the coupling device, which ensures a type of bending, in which the hinged element is pivoted in relation to the coupling device, and an extension, in which the hinged element is basically disposed in a line, or flush to the coupling device, when the handle is actuated in order to open the door or hatch.

In order to securely attach the hook to the hinged element in order to ensure the moving coupling to the coupling device, a simple structural possibility exists in that the form-fitting connection comprises the actuating element screwed into a thread of the hinged element, which secures the free end of the hook.

In this regard, the actuating means could be screwed to the hook, requiring, however, an additional threading, and which would increase the need to maintain manufacturing tolerances, in order for the actuating means to actually be able to be screwed to the hinged element and well as to the hook. For this reason, in an advantageous design, the invention provides that the actuating means is inserted through a hole formed in the free end of the hook to create the form-fitting connection. The actuating means is screwed into the hinged element thereby.

With a door handle assembly according to the type described in the introduction, the handle mount is first attached to the back surface of the door (inside), and the handle is then installed on the outside of the door. The first end of the handle is pivotally secured to the handle mount thereby, and the second end of the handle is releasably secured to the coupling device, which is already pivotally supported on the handle mount attached to the inside of the door. In order to simplify this securing of the second end or hook to the coupling device, the lever-like coupling device must be moved into an installation position, through which the hook that is to be coupled to the second end of the handle is disposed in the proximity of the hole in the door dedicated to it. The installation position is to be maintained thereby until the securing of the second end or hook of the handle is complete. In the prior art, this has required locking elements, which are difficult to bring into their locking position, and must then be released therefrom, and possibly removed. This effort is eliminated in the door handle assembly according to the invention, because the invention provides in this regard that, in order to install the free end of the hook of the handle on the coupling device, the movement of coupling device is defined by the actuating means in that the actuating means is disposed such that it protrudes from the hinged element, such that the protruding longitudinal end of the actuating means bears on a bearing surface formed on the coupling device, such that a relative movement between the hinged element and the coupling device is blocked. The bearing surface can be designed thereby such that the top surface and/or the circumference of the head of the actuating means are supported in sections.

In order to obtain a modular construction of the door handle assembly, in which the individual components can be easily connected to one another, and readily removed and replaced, it is furthermore provided in the design of the invention that the articulated joint comprises at least one receiving hole formed in the hinged element, and at least one hinge pin protruding laterally from the pivot lever, wherein the at least one hinge pin is rotatably supported in the at least one receiving hole. The at least one hinge pin of the pivot lever is subsequently inserted into the corresponding hole formed in the hinged element in the manner of a plug-in connection.

Through the door handle assembly according to the invention, having the hinge-like hinged element, in contrast to the door handle assemblies from the prior art, in which the hook of the handle is non-rotatably connected to the coupling device, there is now the possibility of securely tightening the first end of the handle in place. By tightening the first end of the handle in place, slackness is effectively eliminated, such that snapping movements of the handle when it is actuated are substantially eliminated, giving the impression of a more refined door handle assembly. The door handle assembly according to the invention also has the advantage when it is being removed that, through the blocking of the rotation of the actuating element, the actuating element is prevented from forcing the hinged element out of position on the coupling device.

It is understood that the features specified above and explained below can be used not only in the respective specified combinations, but also in other combinations or in and of themselves, without abandoning the scope of the present invention. The scope of the invention is defined only by the Claims.

BRIEF DESCRIPTION OF THE DRAWINGS

Further details, features and advantages of the subject matter of the invention can be derived from the following description in conjunction with the drawings, in which a preferred exemplary embodiment of the invention is depicted by way of example. Therein.

DETAILED DESCRIPTION

Figure 1:
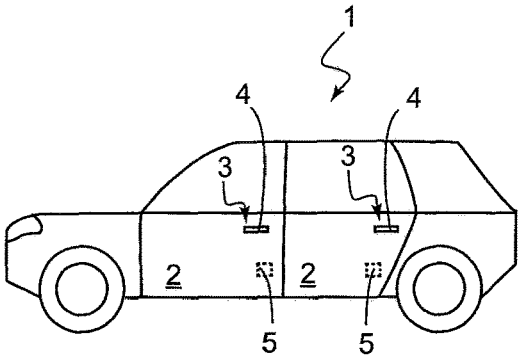
FIG. 1 shows a side view of a motor vehicle having numerous door handle assemblies according to the invention.

A vehicle, or motor vehicle 1 in the form of a passenger car is depicted by way of example in FIG. 1, which has four doors 2 (two of which are visible in FIG. 1) in the example, which can be opened via a door handle assembly 3 and in particular using a handle 4. The doors 2 are securely closed via respective locking assemblies 5, and can only be opened from the outside via a respective movement of the handle 4. This movement of the handle 4 can comprise a pulling and/or pivotal movement, wherein the movement of the handle 4 is transferred mechanically via a (mechanical) coupling device 6 to the corresponding locking assembly 5 (see FIG. 3 or 4, by way of example). The corresponding locking assembly 5, and thus the associated door 2, can then be opened through the movement of the handle 4.

Figure 2:
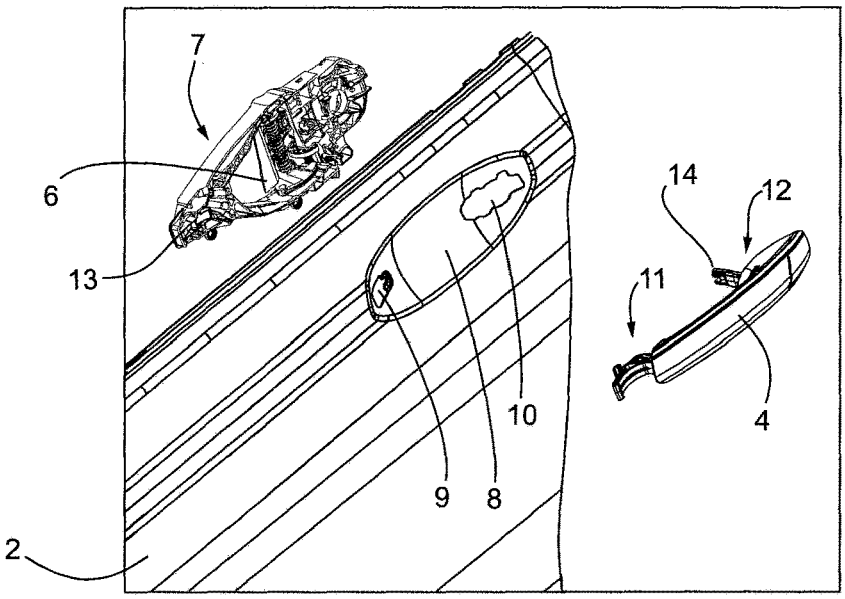
FIG. 2 shows a perspective view of a door, on the inside of which a handle mount, and on the outside of which a handle are disposed, in order to form a door handle assembly according to the invention.
Figure 3:
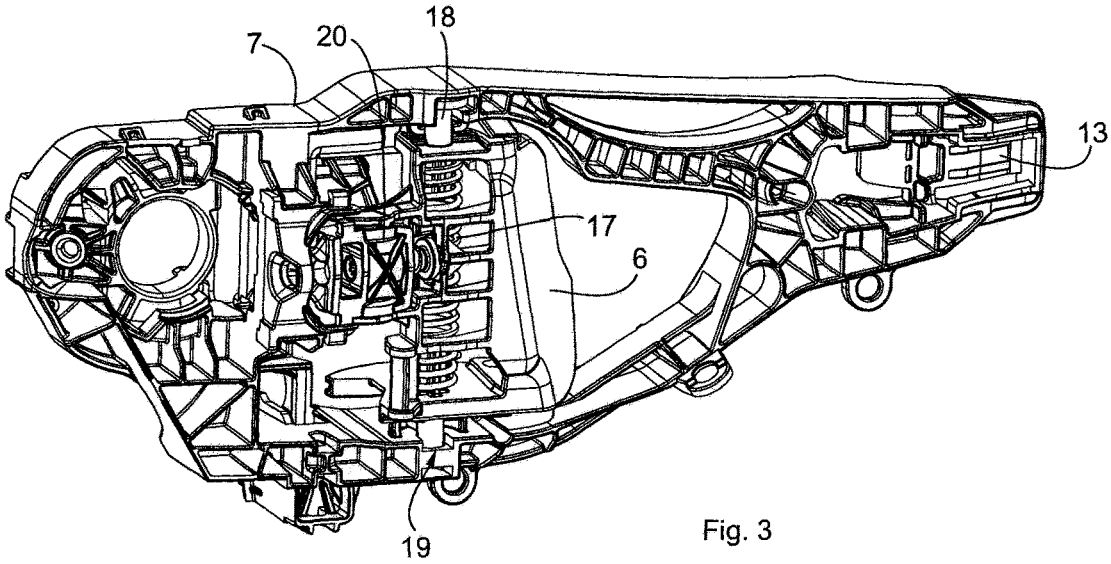
FIG. 3 shows a perspective view of a handle mount of the door handle assembly according to the invention.
Figure 4:
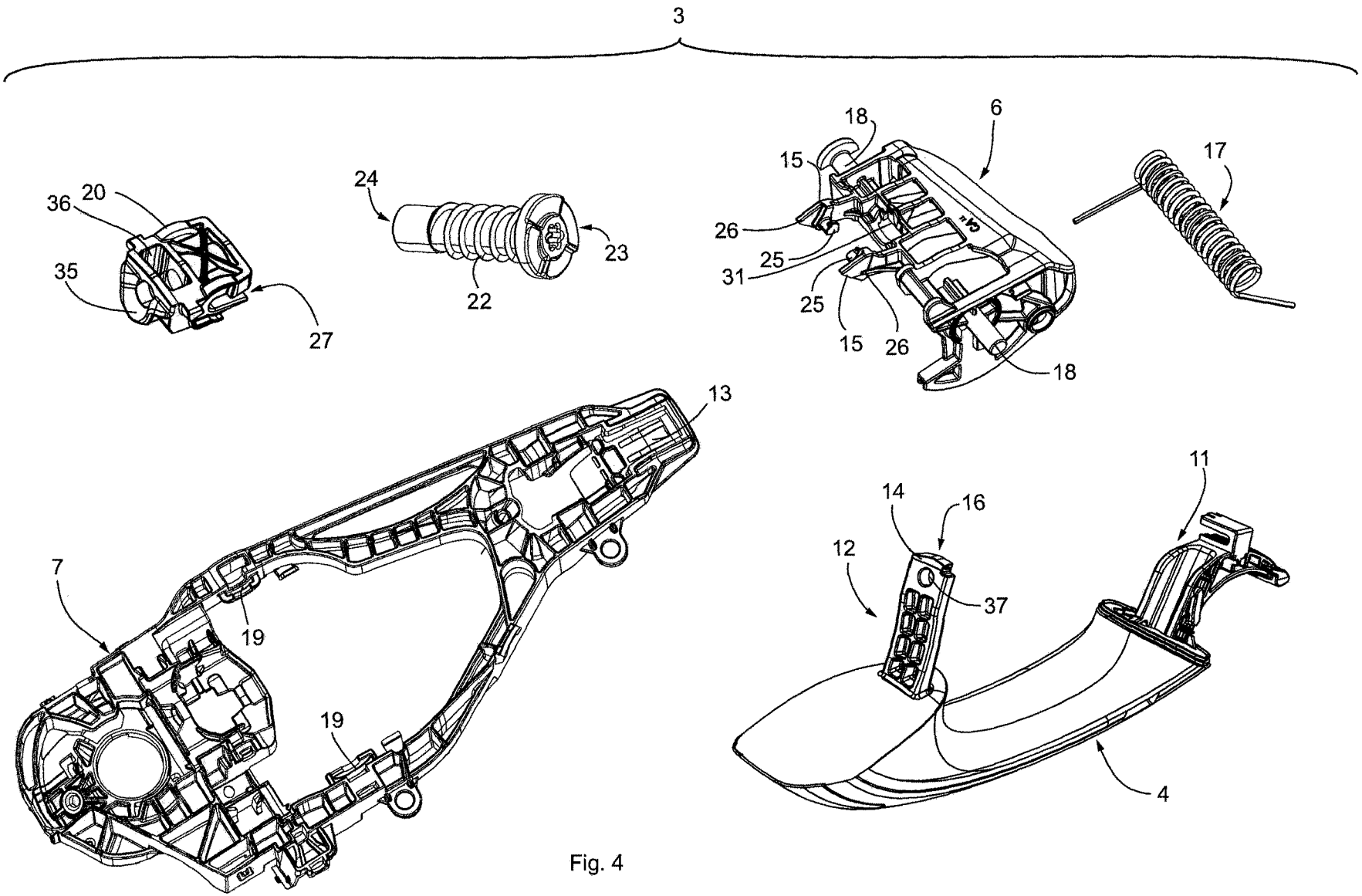
FIG. 4 shows a perspective illustration of the individual components of the door handle assembly according to the invention.
Figure 5:
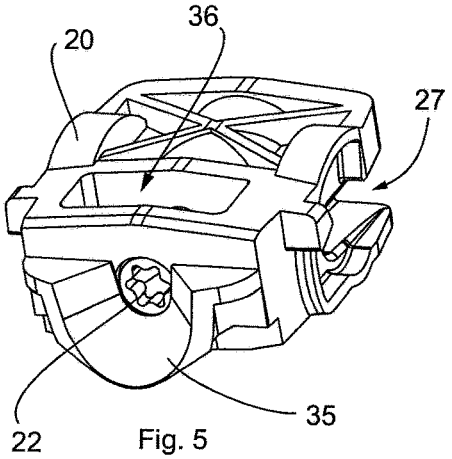
FIG. 5 shows a hinged element of the door handle assembly in a perspective view.

The door handle assembly 3 according to the invention is shown in greater detail in FIGS. 2, 3 and 4 in various illustrations of different positions. It can be derived from FIGS. 2, 3 and 4 that the door handle assembly 3 has a frame-like handle mount 7, wherein for reasons of clarity, the handle 4 is not shown in FIG. 3. The handle mount 7 is used in the known manner for attaching the handle 4, and is attached to the inside of the door 2 by means of screw connections, not shown, wherein the handle 4 is disposed on the outside of the door 2, as indicated in FIG. 2. In order to save on materials, the handle mount 7 has a frame-like construction, having various receiving and bearing spaces, in order to be able to receive the handle 4, among other things, which is moveably and/or pivotally supported on the handle mount 7 in order for a user to be able to open a corresponding door 2 of the motor vehicle 1.

As is shown in FIG. 2, the door 2 has an outer handle depression 8, having two cut-outs 9 and 10, through which the curved handle 4 extends at its first end 11 and its second end 12, when the door handle assembly 3 is assembled. Thus, the first end 11 of the handle 4 extends through the first cut-out 9, and tightened securely to a bearing element 13 of the handle mount 7. The securing of the handle 4 at the end furthermore enables an upward pivoting of the handle 4 over a vertical axis. The second end 12 of the handle 4 extends through the second cut-out 10 formed in the door 2 after the door handle assembly 3 has been installed, and interacts with the coupling device 6 in order to actuate the locking assembly 5. The second end 12 is formed with a hook 14 and the mechanical coupling device 6 is formed with a pivot lever 15 (see FIG. 4, by way of example). The pivot lever 15 of the coupling device 6 is coupled thereby to the free end 16 of the hook 15 of the second end 12 of the handle 4 (see FIG. 4, by way of example).

A movement of the handle 4 can be transferred to the vehicle-side locking assembly 5 through the mechanical coupling device 6, which is rotatably supported on the handle mount 7, when the door handle assembly 3 is assembled, in order to open the door 2. The coupling device 6 can be pivoted in the selected exemplary embodiment, counter to the force of a mechanical reset element 17 designed as a spring, from a standby position (see FIGS. 14 and 16, by way of example) when the handle 4 is not actuated, into an end position (see FIGS. 15 and 17, by way of example), in which the handle 4 is actuated, wherein the spring element, or reset element 17, forces the coupling device 6, together with the handle 4, from the end position back into its standby position. The coupling device 6 is rotatably supported on the handle mount 7 by means of axle elements 18 in appropriate bearing positions 19 of the handle mount 7 (see FIG. 4, by way of example), wherein the spring element, or reset element 17, is retained by the axle elements 18, and bears on the coupling device 6 as well as the handle mount 7, in order to produce the force acting against the pivotal movement when it is pivoted outward, and to return it to the desired standby position.

Figure 6:
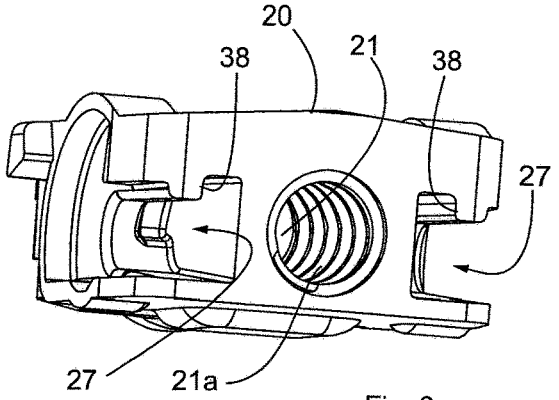
FIG. 6 shows the hinged element from FIG. 5 in another perspective view.
Figure 7:
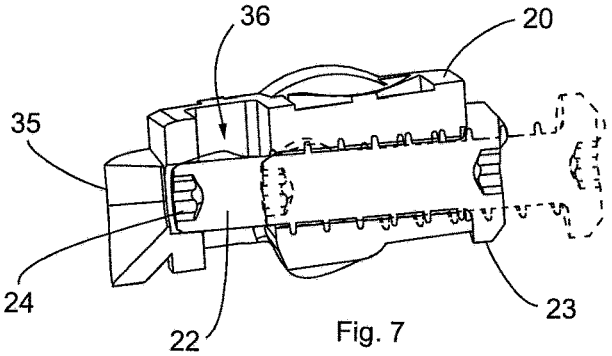
FIG. 7 shows the hinged element from FIG. 5 in a sectional view.

The handle 4 can be coupled at its second end 12 to the coupling device 6 pivotally supported on the handle mount 7. The handle 4 is thus moveably coupled to the locking assembly 5 when it is actuated in order to open the door 2 of the motor vehicle 1. For this moveable coupling, the door handle assembly 3 also has a hinged element 20, in addition to the handle mount 7, the coupling device 6 rotatably supported on the handle mount 7, and the handle 4 attached at its first end 11 to the handle mount 7. The hinged element 20, which is shown in detail, for example, in FIGS. 4 to 7, has a through hole 21 with a threading 21*a* (see FIG. 6, by way of example), into which an actuating means 22 in the form of a screw is screwed, serving to secure the hook 14. Both the head 23, or screw head, formed on a longitudinal end, as well as the base, or screw base 24 of the actuating means 22 each have a hexagon socket for manipulating the actuating means 22, as well as for its adjustment inside the through hole 21 with an appropriate tool. Accordingly, the actuating means 22 is supported in the through hole 21 of the hinged element 20 such that it can be moved in a translatory manner, by rotation thereof, between an installation position and an operating position, wherein the actuating means 22 is shown in the operating position in FIG. 7 with a solid line, while in contrast, the installation position of the actuating means 22 is depicted in FIG. 7 by means of the broken line.

In order to install the door handle assembly 3 according to the invention, the door mount 7 shown in FIG. 3 is pre-installed, i.e. all of the components to be attached thereto, such as the emergency locking cylinder, crash locks, etc. are attached to the handle mount 7 before the handle mount 7 is installed on the door 2, and it is then screwed to the inside of the door 2 of the motor vehicle 1. Prior to this, however, the coupling device 6, including the hinged element 20, is attached to the handle mount 7. The coupling device 6 is placed with its axle elements 18 in the corresponding bearing positions 19 of the handle mount 7, such that the coupling device 6 is rotatably supported via the axle elements 18. Subsequently, the hinged element 20 is then connected to the coupling device 6 supported on the handle mount 7. For this, the mechanical coupling device 6 has two hinge pins 25 in the depicted exemplary embodiment, onto which the hinged element 20 is placed. A respective hinge pin 25 extends laterally from a respective arm 26 of the two-armed pivot lever 15. The two hinge pins 25 extend between the two arms 26 of the pivot lever 15. The hinged element 20 has two lateral receiving recesses 27, open on one side, which make it possible to place the hinged element 20 on the two-armed pivot lever 15 of the coupling device 6, in that the hinge pins 25 are inserted in the receiving recesses 27. The hinge pins 25 make it possible to rotate the hinged element in relation to the two-armed pivot lever 15, as shall be explained in greater detail below. The hinge pins 25 received in the receiving recesses 27 form a hinged connection 28 (see FIG. 15 by way of example) between the hinged element 20 and the coupling device 6. In order to form the hinged connection 28, it is sufficient when it comprises at least one receiving recess 27 formed in the hinged element 20, and at least one hinge pin 25 protruding laterally from the pivot lever 15, wherein the at least one hinge pin 25 must be rotatably supported in the at least one receiving recess 27.

The hinged connection 28 is part of an articulated connection 29 (see FIG. 15, by way of example), through which the second end 12 can be pivoted in relation to the pivot lever 15 when the handle is actuated. In addition to the hinged connection 28, a form-fitting connection 30 belongs to the hinge-like articulated connection 29 (see FIG. 15, by way of example). In this manner, the second end 12 of the handle 4 and the pivot lever 15 of the coupling device 6 are moveably coupled to one another by means of the hinge-like articulated connection 29 that allows the second end 12 to pivot in relation to the pivot lever 15 when the handle 4 is actuated.

FIGS. 9 to 17 schematically illustrate the interaction of the coupling device 6, the second end 12 of the handle 4, and the hinged element 20, wherein for reasons of clarity, the handle mount 7 is not depicted in some of the Figures, for example, and instead, only the relevant components are shown and, in particular, described.

Figure 9:
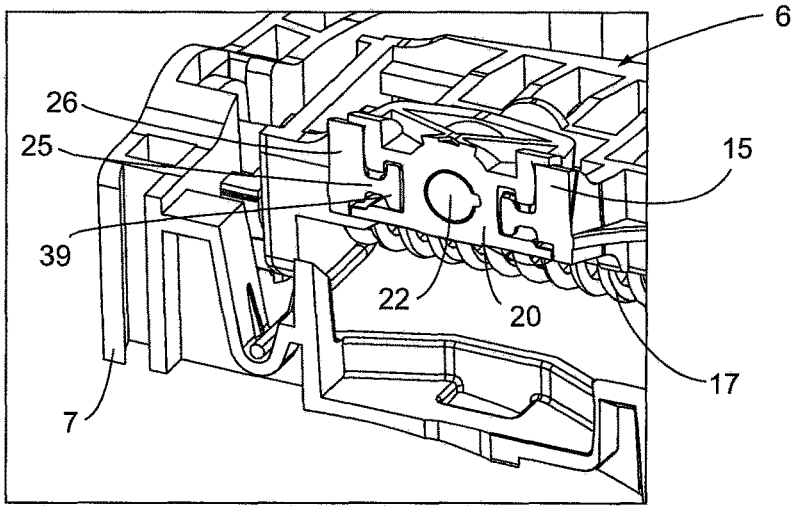
FIG. 9 shows the mounting element attached to the coupling device, in a perspective sectional view.
Figure 10:
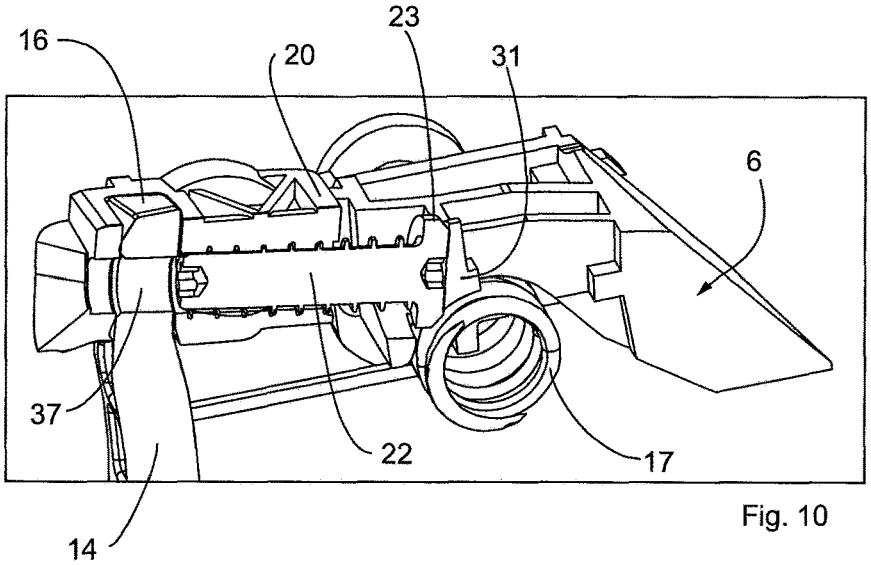
FIG. 10 shows a perspective sectional side view of the mounting element attached to the coupling device, wherein an actuating means screwed into the hinged element provides a mounting position for the hinged element and coupling device for securing a hook of a handle to the handle mount.
Figure 11:
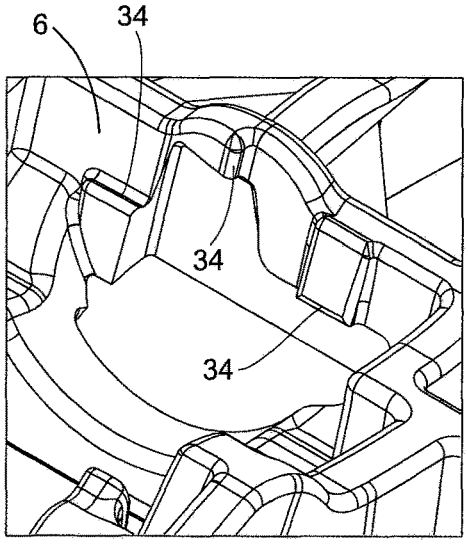
FIG. 11 shows an enlarged depiction of a blocking surface of the coupling device.
Figure 12:
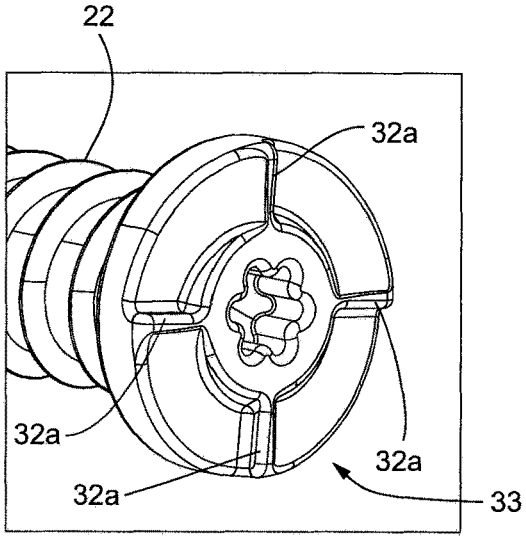
FIG. 12 shows an enlarged depiction of a toothing formed on the top of the actuating element.

In FIGS. 9 and 10, the hinged element 20 is connected via the hinged connection 28 to the coupling device 6, while in contrast, the hook 15 of the second end 12 of the handle 4 is not yet attached to the hinged element 20. The actuating means 22 assumes the installation position indicated by a broken line in FIG. 7, in which the actuating means 22 extends out of the hinged element 20 such that its head 23 projects therefrom. When the actuating means 22 is in the installation position, in which the actuating means 22 is not engaged with the handle 4, the head 23 bears on a blocking surface 31 formed on the coupling device 6 (see FIG. 10, by way of example), such that a relative movement between the hinged element 20 and the coupling device 6 is blocked. The blocking surface 31 is formed such that a rotation, which previously moved the head 23 toward the blocking surface 31 in a translatory manner, is blocked. The blocking of the rotation is produced thereby by a toothing 32 formed on the surface of the head 33 of the actuating means 22 (see FIG. 12, by way of example), and is in an operative connection to the blocking surface 31 accordingly. In this regard, the blocking surface 31 has stop surfaces 34 (see FIG. 11), wherein at least one stop surface 34 is sufficient, such that a tooth 32*a* of the toothing 32 (see FIG. 12) of the actuation means 22 can bear accordingly on the stop surface 34. In this regard, it is likewise sufficient when the toothing 32 is formed by at least one tooth 32*a*. Consequently, at least one tooth 32*a* of the actuating means 22 bears on a stop surface 34 of the blocking surface 31 of the coupling device 6 when the actuating means 22 is in the installation position, such that a rotation of the actuating means 22 beyond the installation position is blocked. The stop surfaces 34 represent so-called rotational stops, which absorb the torque of the actuating means 22 in the form of a screw, as a result of which an axial force never arises between the actuating means 22 and the hinged element 20, which would otherwise push the hinged element 20 out of its position on the coupling device 6 if the blocking of the rotation described above did not exist. Accordingly, the actuating means 22 can only be rotated out of the installation position, by means of which the actuating means 22 would be moved in a translatory manner into the through hole 21, toward the operating position.

As an alternative to the toothing, the head surface 33 of the actuating means 22 can also be designed as a simple stop surface, while in contrast, the surface of the blocking surface 31 exhibits a roughness, which prevents a rotation of the actuating means 22 due to friction.

Figure 13:
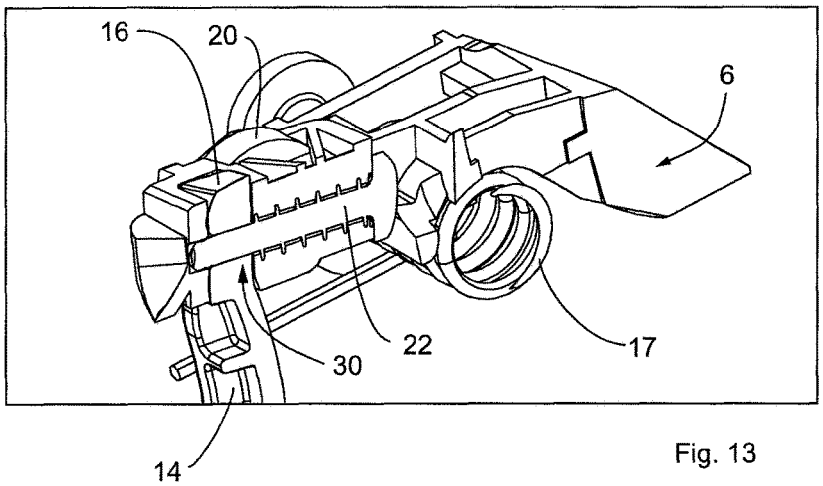
FIG. 13 shows a perspective sectional side view of the mounting element attached to the coupling device, wherein the actuating means screwed into the hinged element provides a standby position for the hinged element and coupling device, and results in the door handle assembly being ready for operation.

As has already been mentioned above, the head 23 of the actuating means 22 is supported, at least in part, by the blocking surface 31, in order to prevent a relative movement between the hinged element 20 and the coupling device 6. In this position, the installation position, the free end 16 of the hook 14 can be inserted into a through shaft 36 (see FIG. 7, by way of example) in order to install the handle 4 on the handle mount 7, which is substantially perpendicular to the through hole 40. In order to form the form-fitting connection 30, which is produced during the installation of the handle 4, the actuating means 22 is then inserted or screwed into a through hole 37 formed on a free end 16 of the hook 14, such that the handle 4 is secured. This is shown in FIG. 13, in which the actuating means 22 bears with its head 23 on the hinged element 20, and is fully screwed into the hinged element 20, as is characteristic of the form-fitting connection 30. In order to simplify the manipulation or handling of the actuating means 22 to change its position (installation position and operating position) in the hinged element 20 from the installation position shown in FIG. 10 into the operating position shown in FIG. 13, the hinged element 20 has an installation funnel 35 facing the actuating means 22, which aids in inserting and aligning a tool for adjusting the position of the actuating means 22 in the hinged element 20.

After installing the handle 4 on the handle mount 7, as described above, the handle can then be moved between its standby position (when the handle 4 is not actuated) and an end position (when the handle 4 is actuated in order to open the door 2). The actuating means 22 that is now fully screwed into the hinged element 20 is then disposed such that it runs through the through hole 37 of the hook 14, and in this manner secures the hook 14, fixing it in place.

Figure 14:
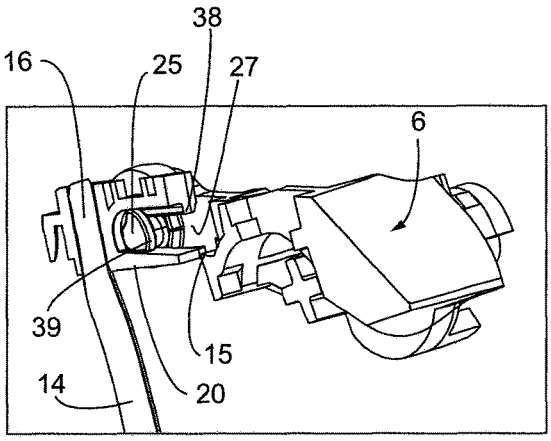
FIG. 14 shows another sectional side view of the coupling device and the hinged element in the standby position when the handle is not actuated.
Figure 15:
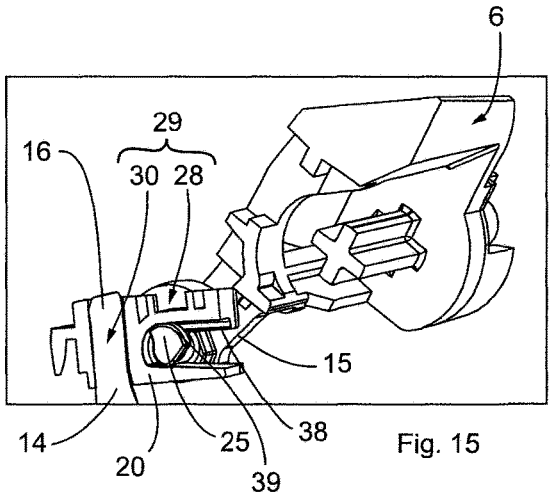
FIG. 15 shows another sectional side view of the coupling device and the hinged element in the end position, when the handle is actuated.
Figure 16:
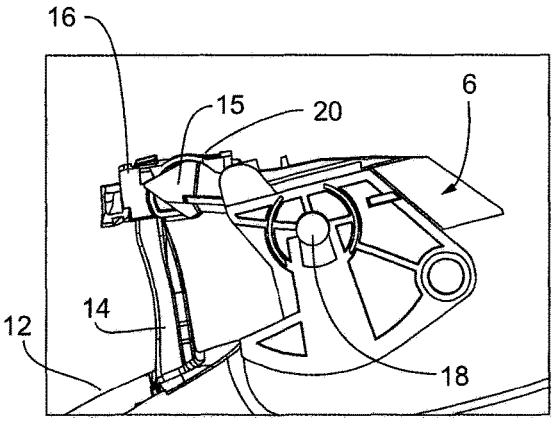
FIG. 16 shows a side view of the coupling device and the hinged element in the standby position, when the handle is not actuated.
Figure 17:
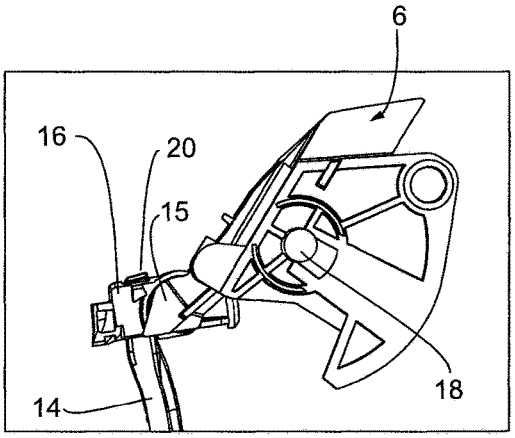
FIG. 17 shows a side view of the coupling device and the hinged element in the end position, when the handle is actuated.

FIGS. 14 and 16 show different views of the standby position, while FIGS. 15 and 17 show views corresponding to FIGS. 14 and 16, in which the handle 4 is located in its end position. In the standby position, the hook 14 is nearly perpendicular to the two-armed pivot lever 15. Furthermore, in the standby position the arms 26 of the pivot lever 15 are disposed in alignment with the hinged element 20, such that the articulated connection 29 is in an extended position. When the handle 4 is actuated, the hook 14 moves substantially downward in FIGS. 14 to 17. As a result of this movement of the hook 14 of the handle 4, the hinged element 20 that is non-rotatably connected to the free end 16 likewise moves downward, thus away from the handle mount 7. As a result of the moveable coupling of the second end 12 of the handle 4 to the pivot lever 15 of the coupling device 6, which is produced by means of the articulated connection 29, the pivot lever 15 is also pulled downward, away from the handle mount 7, by means of which the coupling device 6 rotates about the axle elements 18 rotatably supported in the bearing positions 19. Moreover, the pivot lever 15 is pivoted in relation to the hinged element 20 thereby, which is possible as a result of the hinge pins 25 rotatably supported in the receiving recesses 27 (see FIG. 15, by way of example). Consequently, the articulated connection 29 is in a type of bowed state, in which the pivot lever 15 is pivoted in relation to the hook 14 of the handle 4, which is possible because of the hinge-like articulated connection 29, which comprises both the form-fitting connection 30 between the hook 14 and the hinged element 20, as well as the hinged connection 28 between the hinged element 20 and the pivot lever 15.

Figure 8:
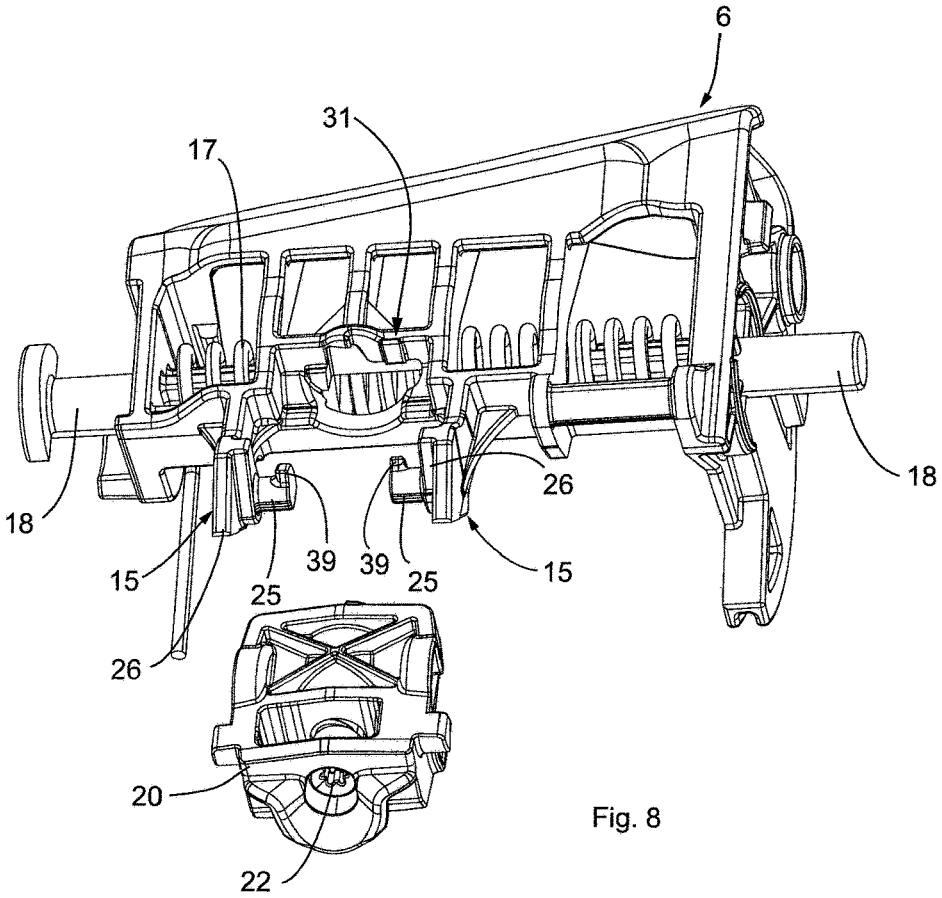
FIG. 8 shows the mounting element and a coupling device prior to assembly, in a perspective view.

The receiving recesses 27, which are open toward the coupling device 6 on one side, each have at least one step 38 in their cross section (see FIG. 6, by way of example), while in contrast, the hinge pins 25 each have at least a partially flaring head 39 (see FIG. 8, by way of example). The flaring head 39 is formed as a semi-circular beading in the exemplary embodiments shown herein, which is disposed lying behind the step 38 in the hinged element 20, preventing a lateral relative movement of the hinged element 20 and the coupling device 6. The flared head 39 is disposed in any case behind the step 38 inside the hinged element 20 (as can be seen, by way of example, in FIGS. 14 and 15), such that a lateral movement of the pivot lever 15 is prevented.

The invention described above is not limited to the embodiments described and illustrated herein. It is clear that numerous modifications, obvious to the person skilled in the art, in accordance with the intended use, can be made to the embodiments depicted in the drawings, without abandoning the scope of the invention. Everything contained in the description and/or depicted in the drawings belongs to the invention, including that which is obvious to the person skilled in the art, deviating from the concrete exemplary embodiments.

The invention claimed is:

1. A door handle assembly for a motor vehicle, including a handle mount that is installed on the vehicle, a handle rotatably supported on the handle mount for opening a door or hatch of the motor vehicle, and a coupling device rotatably supported on the handle mount, through which an actuation of the handle is transferred to a locking assembly on the vehicle, wherein a hinged element connects the coupling device and the handle to one another such that they can pivot, wherein the hinged element is supported such that it moves in a translatory manner between an installation position and an operating position through the rotation of an actuating means, which is supported on the coupling device such that the actuating means moves toward the hinged element when the hinged element is in the operating position, and engaged with the handle, and which bears on a blocking surface of the coupling device that blocks a rotation of the actuating means when the hinged element is in the installation position, and disengaged from the handle, wherein the actuating means comprises a screw, a head surface of which includes a toothing operatively connected to the blocking surface when in the installation position, and wherein the blocking surface is formed with at least one stop surface, on which a tooth of the toothing of the actuating means bears when in the installation position, blocking a rotation of the actuating means in order to absorb a torque of the actuating means and to prevent an axial force from occurring between the actuating means and the hinged element.

2. The door handle assembly according to claim 1, wherein a longitudinal end of the actuating means is configured as a bearing surface interacting with the blocking surface in the installed position, and the blocking surface is provided with a roughened surface.

3. The door handle assembly according to claim 1, wherein a first end of the handle is rotatably supported on the handle mount, and a second end of the handle and coupling device are moveably coupled to one another by means of a hinged joint pivots the second end in relation to the coupling device when the handle is actuated.

4. The door handle assembly according to claim 3, wherein the hinged joint comprises the hinged element, which is non-rotatably connected to a hook of the handle formed on the second end via a form-fitting connection when the actuating means is in the operating position, and which is rotatably connected to the coupling device via a hinged connection.

5. The door handle assembly according to claim 4, wherein the form-fitting connection comprises the actuating means screwed into a threading of the hinged element, which secures the free end of the hook in place when it is in its operating position.

6. The door handle assembly according to claim 4, wherein, with the form-fitting connection, the actuating means is inserted through a through hole formed at the free end of the hook.

7. The door handle assembly according to claim 4, wherein, in order to install the free end of the hook of the handle on the coupling device, the movement of the coupling device is defined by means of the actuating means, in that the actuating means is disposed such that it protrudes out of the hinged element, such that the protruding longitudinal end of the actuating means bears on a bearing surface formed on the coupling device, such that a relative movement between the hinged element and the coupling device is blocked.

8. The door handle assembly according to claim 4, wherein the hinged connection comprises at least one receiving recess formed in the hinged element and at least one hinge pin projecting laterally from the coupling device, wherein the at least one hinge pin is rotatably supported in the at least one receiving recess.

* * * * *